US005657535A

United States Patent [19]

Maejima

[11] Patent Number: 5,657,535

[45] Date of Patent: Aug. 19, 1997

[54] TERMINAL INSERTION GUIDE

[75] Inventor: Takamichi Maejima, Shizuoka, Japan

[73] Assignee: Yazaki Corporation, Tokyo, Japan

[21] Appl. No.: 561,806

[22] Filed: Nov. 22, 1995

[30] Foreign Application Priority Data

Nov. 29, 1994 [JP] Japan ..... 6-294210

[51] Int. Cl.[6] ..... H01R 43/20

[52] U.S. Cl. ..... 29/747; 29/33 M; 29/748; 29/755; 29/760

[58] Field of Search ..... 29/33 F, 33 M, 29/747, 748, 754, 861, 881, 755, 759, 760; 269/903

[56] References Cited

U.S. PATENT DOCUMENTS

| | | | |
|---|---|---|---|
| 4,617,731 | 10/1986 | Carrell et al. | 29/33 F X |
| 5,109,602 | 5/1992 | Fukuda et al. | 29/747 X |
| 5,459,924 | 10/1995 | Ohsumi et al. | 29/881 |

FOREIGN PATENT DOCUMENTS

| | | | |
|---|---|---|---|
| 305307 | 3/1989 | European Pat. Off. | 29/748 |
| 391239 | 10/1990 | European Pat. Off. | 29/748 |
| 5-242947 | 9/1993 | Japan | 29/748 |
| 114969 | 5/1995 | Japan | 29/33 M |

*Primary Examiner*—Peter Vo

*Attorney, Agent, or Firm*—Armstrong, Westerman, Hattori, McLeland & Naughton

[57] ABSTRACT

A terminal insertion guide includes a pair of one and another guide arms; and an upper guide wall located between said pair of guide arms and having a surface sloped downward for a terminal wherein the terminal is passed between the pair of guide arms and the upper guide wall to be guided into a terminal chamber of a connector housing. One or both of the pair of guide arms having a plurality of guide strips inclined upward for the upper guide wall. Thus, the terminal, even when inclined downward, can be surely guided into the terminal chamber of a connector housing.

3 Claims, 5 Drawing Sheets

TERMINAL INSERTION GUIDE

BACKGROUND OF THE INVENTION

1. Field of the Invention

The present invention relates to a terminal insertion guide which can surely guide a terminal into a terminal chamber of a connector housing.

2. Description of the Prior Art

In FIG. 7 is shown the prior art terminal insertion guide disclosed in Patent Appln. 5-209145.

The disclosed terminal insertion guide 31 includes a pair of openable/shuttable guide arms 32 and 33. On the inside 34 of the one guide arm 32 is formed an upper guide wall 36 for the terminal 35, and on the other guide arm 33 is formed a groove 38 for the upper guide wall 36. The upper guide wall 36 has a downward slanted guide surface 37. The tip of the terminal 35 can be slid along the inclined guide surface 37 so that the terminal 35 is guided into a terminal chamber 40.

A pair of guide arms 32 and 33 in a united state are inserted between wires 40 extending from the connector housing 39 from above to through the wires 40 in order to spread the wires horizontally. The terminal 35 is passed between the wires 40 which are in a state opened slightly wider than terminal width L. The wire connected to the terminal 35 is held by front and rear pairs of hands 41 and 42. The tip of the terminal 35 is preliminarily inserted into the terminal chamber 40 via cooperation between the guide arms 32 and 33 and secondarily inserted deep by only by the rear hands 42.

However, in the prior art terminal insertion guide 31, when the wire 43 is grasped by hands 41 and 42, its terminal 35 may be located at a position lower than the required terminal chamber 40 or, alternatively, may be inclined downward. In such a case, the sloped guide surface 37 of the upper side guide wall 36 is of no use. Namely, the terminal 36 will escape downwards to bump against the lower opening end 40*a* of the terminal chamber 40 so that the insertion operation fails. In order to prevent this, the posture of the terminal 35 must be previously corrected, and/or the terminal grasping accuracy of the hands 41 and 42 must be previously increased.

SUMMARY OF THE INVENTION

An object of the present invention is to provide a terminal insertion guide which can insert a terminal of an electric wire into a terminal chamber even when the terminal is located at a lower position than that of a required terminal chamber, or is grasped in a posture inclined downward.

In order to attain the above object, there is provided a terminal insertion guide comprising: a pair of guide arms; an upper guide wall located between said pair of guide arms and having a surface inclined downward for a terminal wherein the terminal is passed between said pair of guide arms and said upper guide wall to be guided into a terminal chamber of a connector housing, and one or both of said pair of guide arms having a plurality of guide strips inclined aslant upward for said upper guide wall in their inner surface.

In accordance with the present invention, in inserting a terminal in a terminal chamber, a terminal located at a position lower than a required terminal chamber or inclined downwards has its inclination corrected upward by the inclined guide strips of the guide arm. The wire, therefore, does not escape downward between the pair of guide arms and the upper guide wall but is surely inserted into the required terminal chamber of the connector housing. Thus, the success rate of terminal insertion in an automatic terminal insertion step can be improved. In addition, the operation of correcting the posture of the terminal before insertion is made unnecessary, and the terminal may be relatively roughly positioned using grasping hands. This contributes to a reduction in the production cost and in an increase in production speed in producing wire harnesses.

The above and other objects and features of the present invention will be more apparent from the following description taken in conjunction with the accompanying drawings.

DESCRIPTION OF THE PREFERRED EMBODIMENTS

Figure 1:
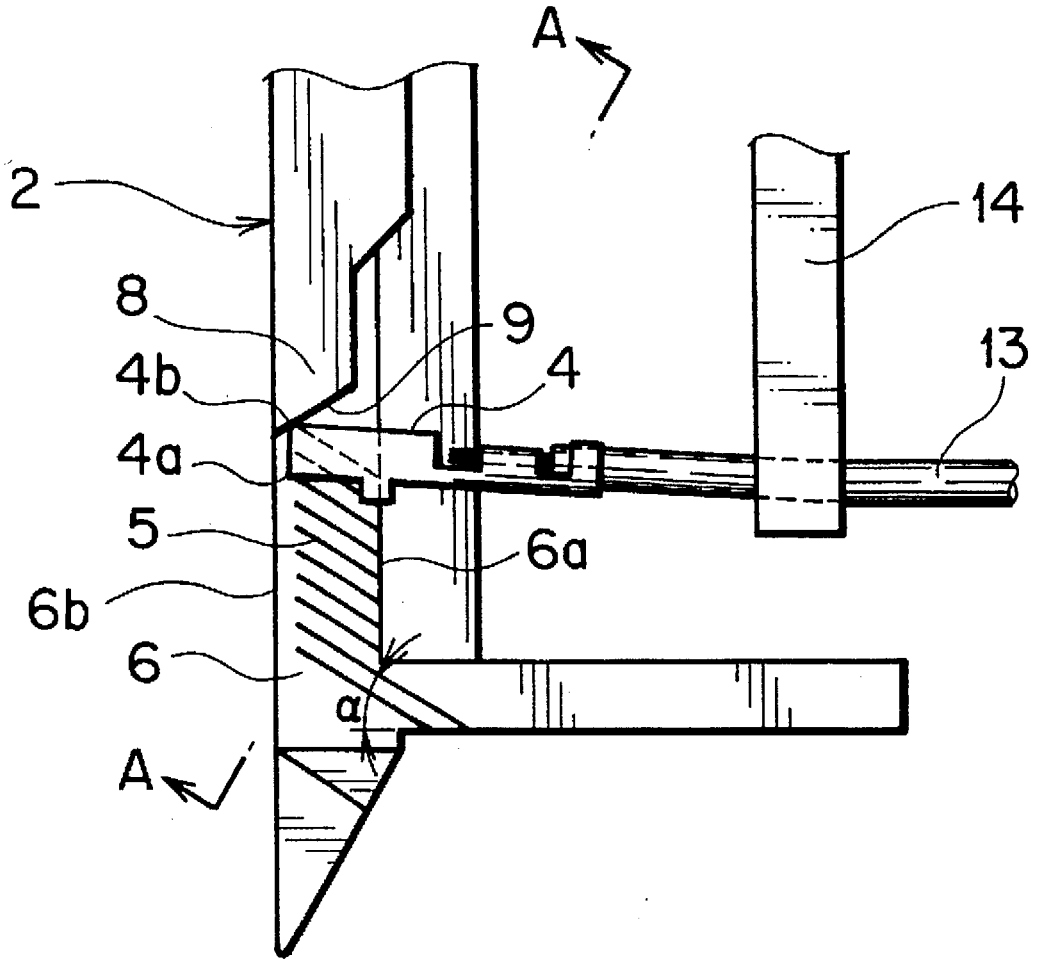
FIG. 1 is an inner side view showing an embodiment of a terminal insertion guide according to the present invention.

FIGS. 1 to 4 show an embodiment of a terminal insertion guide-according to the present invention.

A terminal insertion guide 1 according to this embodiment is characterized in that one or both of a pair of guide arms 2 and 3 have a plurality of upward inclined guide strips 5 for a terminal 4. As seen from FIGS. 1 and 2, the plurality of strips 5 are formed in parallel in an area ranging from the lower position of the inner side guide surface of the guide arm 2 on the right side in a terminal insertion direction to a position close to a downward sloped surface 9 of an upper side wall 8.

Figure 2:
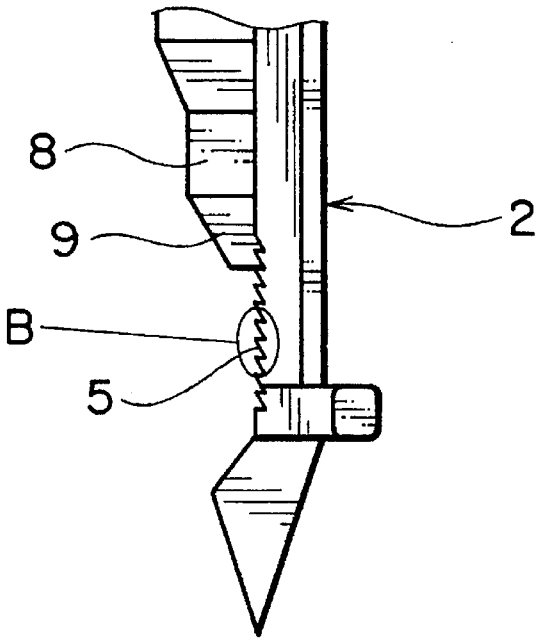
FIG. 2 is sectional view taken along line A—A in FIG. 1.
Figure 3:
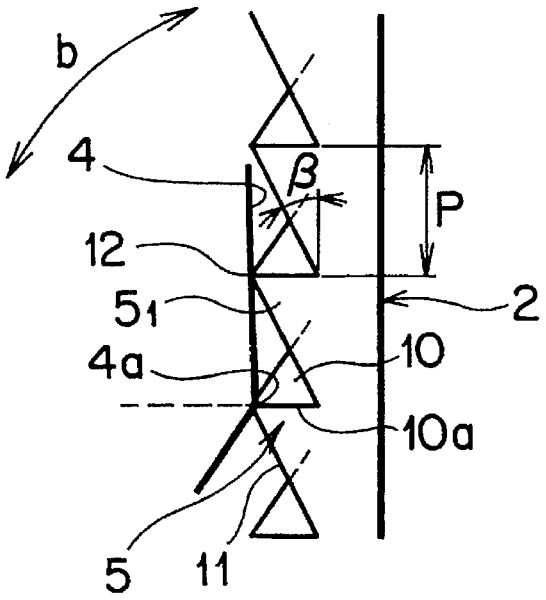
FIG. 3 is an enlarged perspective view showing part B of FIG. 2.

The inclined guide strips 5 are formed in a saw-tooth shape, as shown in FIG. 3 which is an enlarged perspective view of part B in FIG. 2. Each of the plurality of strips 5 has an upward sloped guide surface 10 and a downward sloped surface 11. The upward inclined guide surface 10 has a horizontal trailing edge 10*a* whose direction is perpendicular to the longitudinal direction of the guide arm 2. The upward sloped guide surface 10 serves to guide the terminal 4 upward with the lower side corner 4*a* of the tip of the terminal 4 carried on the guide surface 10.

In FIG. 1, the inclination angle $\alpha$ of the inclined guide strips 5 is preferably about 30° from a horizontal line. When the angle exceeds 30°, the tip 4*a* scratches and cannot be smoothly moved. When the angle is smaller than 30°, the rising distance cannot be increased. The upward sloped guide surface 10 is perpendicular to the inner wall of said guide arm 2 in its longitudinal direction. Further, the sloping angle $\beta$ of the downward sloped surface 11 of the inclined guide strips 5 having a saw-tooth shape in FIG. 3 may be also 30°. An increase in the sloping angle $\beta$ of the downward slope 11 leads to a decrease in the pitch P of each of the inclined guide strips 5. When the pitch is relatively small, the apex 12 of an upper inclined guide strip $\mathbf{5}_1$ the side of the terminal 4, thereby bending a direction of an arrow b as shown in FIG. 3. The pitch P of the inclined guide strips 5 may be preferably 1 to 1.5 mm, or so. The opening amount of the pair of guide arms 2 and 3 is set for a value slightly larger than the width of the terminal 4, as in the prior art. For this reason, slight bending of the terminal 4 in the direction of arrow b within clearance between the guide arms 2, 3 and the terminal 4 is not problematic.

In FIG. 1, the plurality of inclined guide strips 5 are formed so as to extend from the rear end 6*a* of the guide arm 2 to a position adjacent the front end thereof, or may penetrate from the rear end 6*a* to the front end 6*b*. The terminal 4 of the wire 13 grasped by the hands 14 is guided aslant upwards along the inclined guide strips 5. With the upper end 4*b* of the tip of the terminal 4 in sliding contact with the downward sloped guide surface 9 of the upper guide wall 8, the terminal 4 is inserted into a required terminal insertion chamber 17 of connector housing 16.

Figures 4A, 4B, 4C:
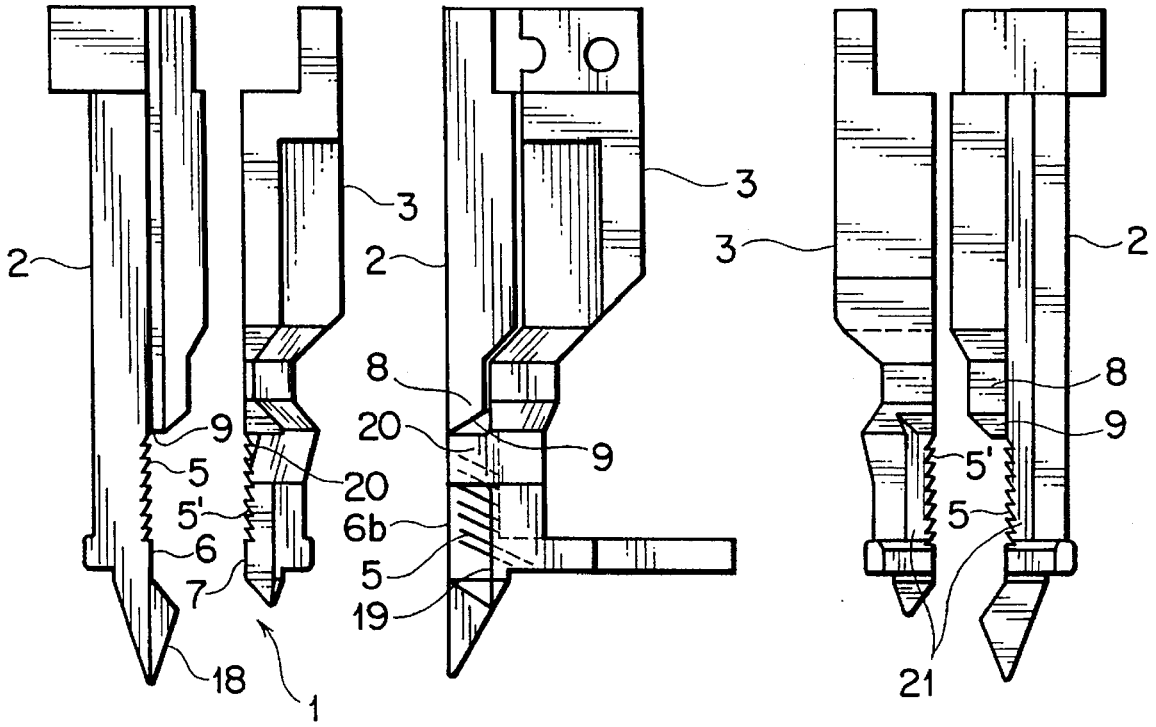
FIGS. 4A, 4B and 4C are a front view, a side view and a rear view of a pair of guide arms, respectively, in a terminal insertion direction.

FIG. 4A is a front view of the pair of guide arms 2 and 3. FIG. 4C is a rear view of the guide arms 2 and 3. As seen from the figures, the guide arm 3 on the left side in a terminal insertion direction also has inclined guide strips 5', as in the guide arm 2 described above. The inclined guide strips 5' are formed to have a shape in symmetry to that of the inclined guide strips 5. The inclined guide strips 5 and 5' of the guide arms 2 and 3 can be fabricated, for example, using the blade of an end mill or a whetstone with a wedge-shaped tip.

In FIGS. 4A to 4C, the guide arm 2 on the right side in the terminal insertion direction has a wedge-shaped tip 18 and the downward sloped guide surface 9 on the upper guide wall 8. The guide arm 3 on the left side has a recess 19 which exposes the half of the front end of the guide arm 2 on the right side and a wedge-shaped terminal guide wall 20 located immediately below the side of the downward inclined guide surface 9. The inclined guide strips 5' are formed in parallel in an area ranging from the lower part of guide arm 3 to the terminal guide wall 20 on the inner side guide surface 7. Both guide arms 2 and 3 are opened or closed by an actuator (not shown). In a united state, the front end 6*b* forms wedge-shape and a guide chamfer is located at a rear end. The detailed structure of each of the guide arms 2 and 3 is disclosed in Japanese Preliminary Publn. 5-209145.

Figure 5:
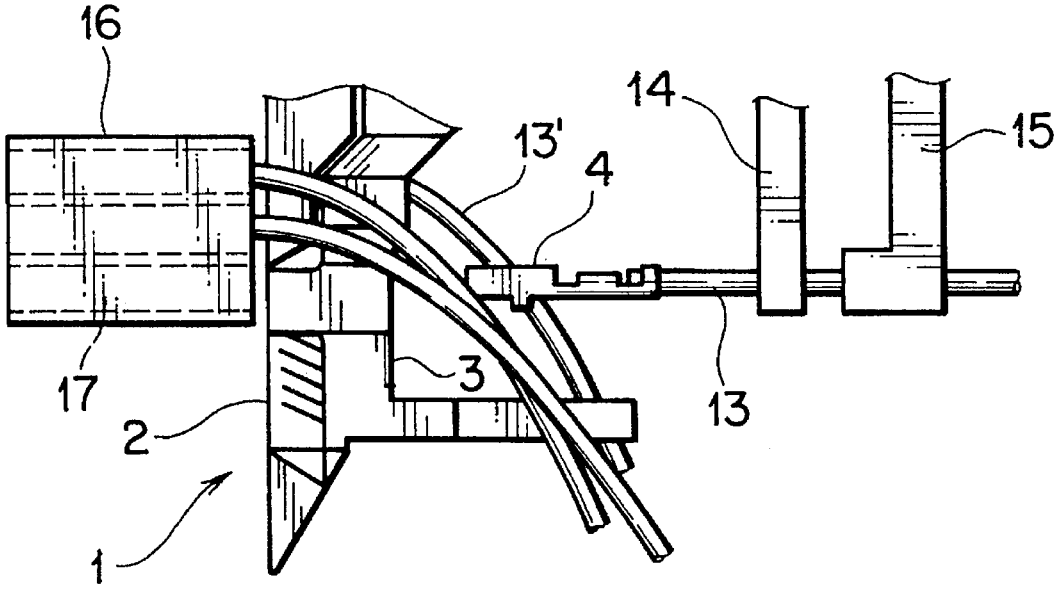
FIG. 5 is a side view of the state where the terminal of an electric wire is to be inserted.
Figure 6:
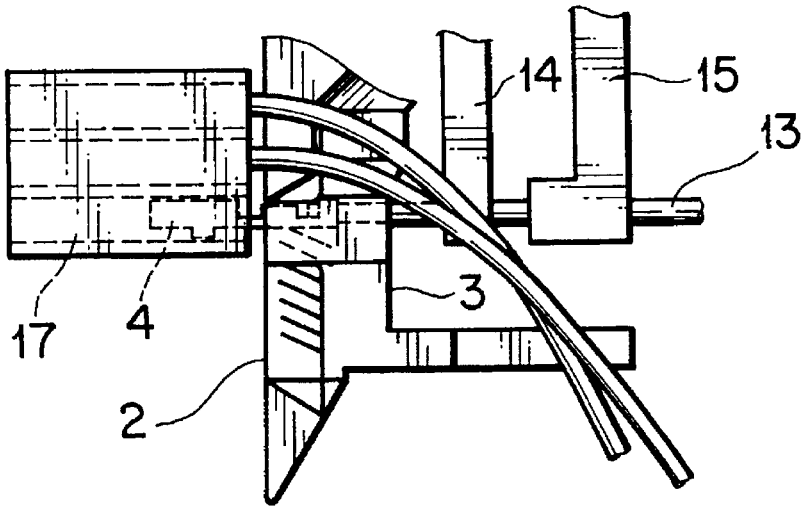
FIG. 6 is a side view of the state in which the terminal has been preliminarily inserted.
Figure 7:
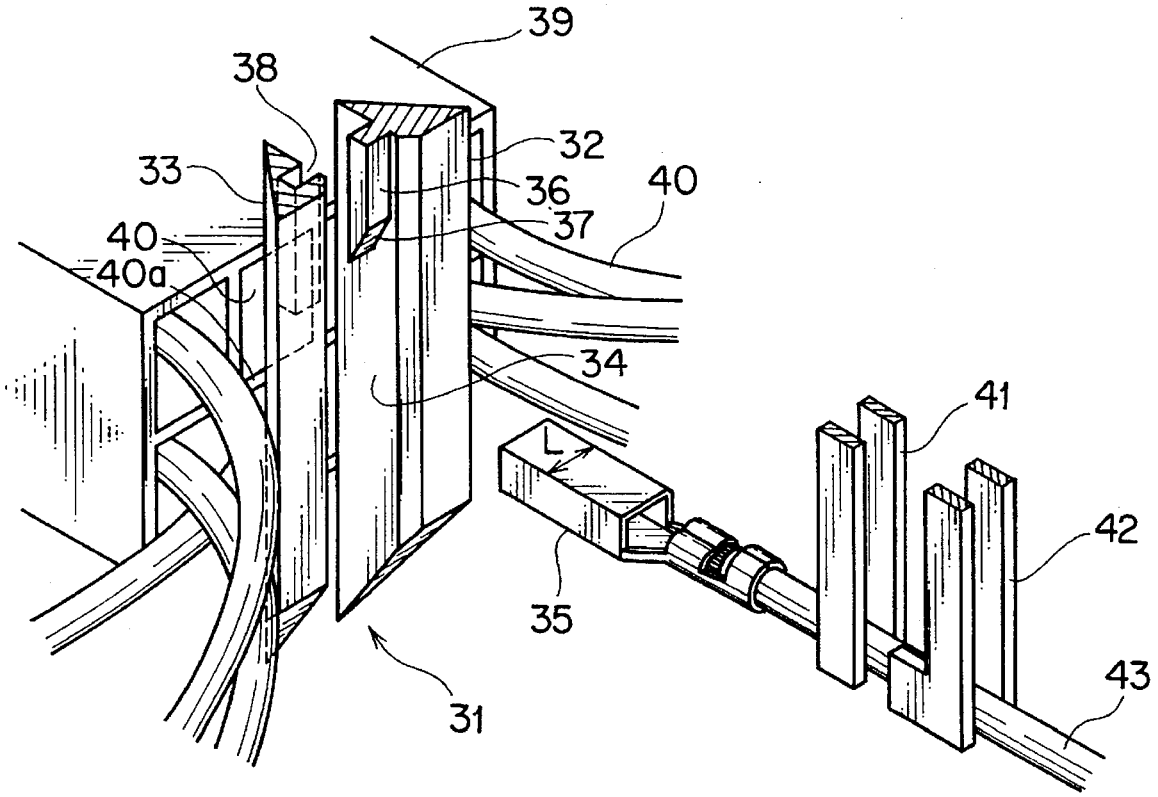
FIG. 7 PRIOR ART
FIG. 7 is a perspective view of the prior art terminal insertion guide.

As shown in FIG. 5, the united guide arms 2 and 3 are inserted between introducing wirings 13'. The terminal 4 is passed between the wires, 13' in a state in which the wires are spread slightly wider than the terminal width L. The terminal 4 is further passed between the guide arms 2 and 3, as shown in FIG. 6, with the connection wire 13 grasped by the hands 14 and 15.

Now, even if the terminal 4 is located at a position lower than a required terminal chamber 17, or inclined downward, it is guided upwards along the inclined guide strips 5, 5' of the guide arms 2, 3. After sliding into contact with the downward sloped guide surface 9 of the upper side guide wall 8 or directly without contact with it, the terminal 4 is guided into the terminal chamber 17. Thus, the tip of the terminal 4 is preliminarily inserted into the terminal chamber. Thereafter, the front hands 14 release the wire and rise, and the rear hands 15 push the wire 13 so that the entire terminal is inserted into the terminal chamber.

The inclined guide strips 5, 5' can be applied to not only the guide arms 2 and 3, which are freely opened or shut, but also to gate-shaped terminal insertion guides (not shown) previously opened to a width larger than the terminal width.

What is claimed is:

1. A terminal insertion guide comprising:

a pair of opposed guide arms having longitudinally extending walls;

an upper guide wall located on one of said guide arms between said pair of guide arms and having a surface sloped downward for guiding a terminal passed between said pair of guide arms and said upper guide wall to be guided into a terminal chamber of a connector housing; and at least one of each of said pair of guide arms having in their inner surface a plurality of tooth-shaped projections forming guide strips inclined upward toward said upper guide wall.

2. A terminal insertion guide according to claim 1, wherein said inclined guide strips are formed of a saw-tooth shape in section and each of said inclined guide strips has an upward sloped guide surface which is perpendicular to inner walls of said guide arms in their longitudinal direction.

3. A terminal insertion guide according to claim 1, wherein said plurality of strips are inclined about 30° from a horizontal line.

* * * * *